US005216877A

United States Patent [19]

Moore, Jr.

[11] Patent Number: 5,216,877

[45] Date of Patent: Jun. 8, 1993

[54] LINEAR ACTUATOR FOR A BLEED VALVE

[75] Inventor: Robert G. Moore, Jr., Granger, Ind.

[73] Assignee: Allied-Signal Inc., Morristown, N.J.

[21] Appl. No.: 830,047

[22] Filed: Jan. 31, 1992

[51] Int. Cl.[5] ..... F02C 9/18

[52] U.S. Cl. ..... 60/39.29; 415/27

[58] Field of Search ..... 60/39.07, 39.27, 39.29; 415/26, 27, 28

[56] References Cited

U.S. PATENT DOCUMENTS

| | | | |
|---|---|---|---|
| 3,172,259 | 3/1965 | North | 60/39.29 |
| 3,646,753 | 3/1972 | Colman et al. | 60/39.29 |
| 3,849,021 | 11/1974 | Eastman et al. | 60/39.29 |
| 3,917,430 | 11/1975 | Bloom et al. | 60/39.29 |
| 3,994,617 | 11/1976 | McCombs | 60/39.29 |
| 4,251,985 | 2/1981 | Sullivan | 60/39.29 |

*Primary Examiner*—Louis J. Casaregola
*Attorney, Agent, or Firm*—Leo H. McCormick, Jr.; Larry J. Palguta; Robert A. Walsh

[57] ABSTRACT

In a control system for a turbine engine having a variable geometry air compressor, a valve arrangement responsive to a first operational pressure differential created between a discharge fluid pressure produced by the air compressor and an environmental fluid pressure for controlling the communication of a first fluid pressure to an actuator assembly which responds to a second operational pressure differential created across a piston between the first fluid pressure and a second fluid pressure produced through a modification of the discharge fluid pressure. The second fluid pressure being developed by compressor discharge fluid pressure flowing from a blind bore in a shaft through a variable opening to one side if the piston while at the same time fluid pressure flows through a restriction to the surrounding environment. The resulting second pressure differential acts on the piston to provide the shaft with a force which is communicated through linkage to linearly change the shape of a variable area geometry device of the air compressor.

5 Claims, 3 Drawing Sheets

LINEAR ACTUATOR FOR A BLEED VALVE

This invention relates to a control system for a turbine engine wherein the geometry of a variable area compressor is changed as a function of the compressor discharge pressure corresponding to a desired operational condition. In this control system, an operational differential pressure derived from the compressor discharge pressure acts on an actuator to develop a linear force to change the geometry of the variable area compressor and correspondingly the resulting discharge pressure.

In a high performance axial flow compressor gas turbine engine, it is often necessary to control the mass air flow through the compressor to avoid characteristic unstable operation of the compressor particularly during an engine acceleration. Air flow may be controlled by bleeding or venting compressor stages to a suitable relatively lower pressure drain source such as disclosed in U.S. Pat. No. 3,849,021 or by varying the effective flow area of the compressor inlet to increase or decrease the mass air flow to the compressor as disclosed in U.S. Pat. No. 2,870,956. It will be recognized that such bleeding of pressurized air or restriction of air flow to the compressor may have an undesirable effect on the efficiency and power of the engine and therefore should be limited to a minimum during engine operation.

Various prior air compressor geometry varying means are disclosed in the prior art such as in U.S. Pat. Nos. 3,172,259, 3,646,753 and 3,849,021. These actuators are adapted to actuate one or more bleed valves to a fully open or closed position in response to selected engine operating parameters. Later a control was developed through which an input to the bleed valve was controlled by a series of incremental steps. However, even with the incremental steps the opening or closing of a compressor bleed valve may have an undesirable effect on compressor operation.

In the present invention, the opening or closing of a variable area geometry is controlled through a linear input developed by an actuator assembly through a modification of the compressor discharge pressure developed in an air compressor. The actuator assembly has a housing with a bore therein. The bore has an inlet port connected to receive a first fluid pressure derived from a first pressure differential between the discharge pressure and the fluid pressure of the surrounding environment and an outlet port connected to the surrounding environment. A piston located in the bore separates a first chamber connected to the inlet port from a second chamber connected to the outlet port. A restriction located in the outlet port controls the communication of any fluid pressure from the second chamber to the environment. A sleeve located in the housing has a radial slot therein. A shaft has a first end journaled in the sleeve and a second end that extends through the housing. The shaft has a blind bore connected to receive compressor discharge fluid pressure and an opening from the blind bore which is aligned in a plane with the radial slot in the sleeve. The shaft is connected to the piston and rotated thereby as a function of linear movement of the piston by the second pressure differential to position the opening with respect to the radial slot to create a variable opening from the blind bore to the second chamber. A resilient member urges the piston toward the first chamber in opposition to the second pressure differential. The second fluid pressure is developed by compressor discharge fluid pressure flowing from the blind bore through the variable opening into the second chamber while at the same time fluid pressure in the second chamber flows through said restriction in the outlet port to the surrounding environment. The second pressure differential which moves the piston and shaft is communicated through a second end of the shaft into linkage connected to the air compressor to linearly change the geometry of the air compressor. The relationship between the radial slot and opening in the shaft is such that the variable opening is closed during the initial and maximum operation of the engine as well as the valve which controls the development of the first fluid pressure to prevent or attenuate the loss of compressor discharge fluid pressure to assure that the maximum force produced by the turbine is available for developing thrust or the turbine engine.

It is an object of this invention to provide a control system for a turbine engine having a variable geometry air compressor with an actuator assembly having a linear operation to prevent abrupt changes in the compressor discharge pressure or horsepower of the turbine.

It is a further object of this invention to provide a means of reducing or eliminating the loss of compressor discharge pressure during the initial or maximum operation of a turbine.

It is a still further object of this invention to provide a control system for a variable geometry air compressor with an actuator assembly which responds to desired engine speed by linearly increasing the operation of the turbine engine.

The objects and advantages of this present invention should be apparent from reading this specification while viewing the drawings wherein.

Figure 1:
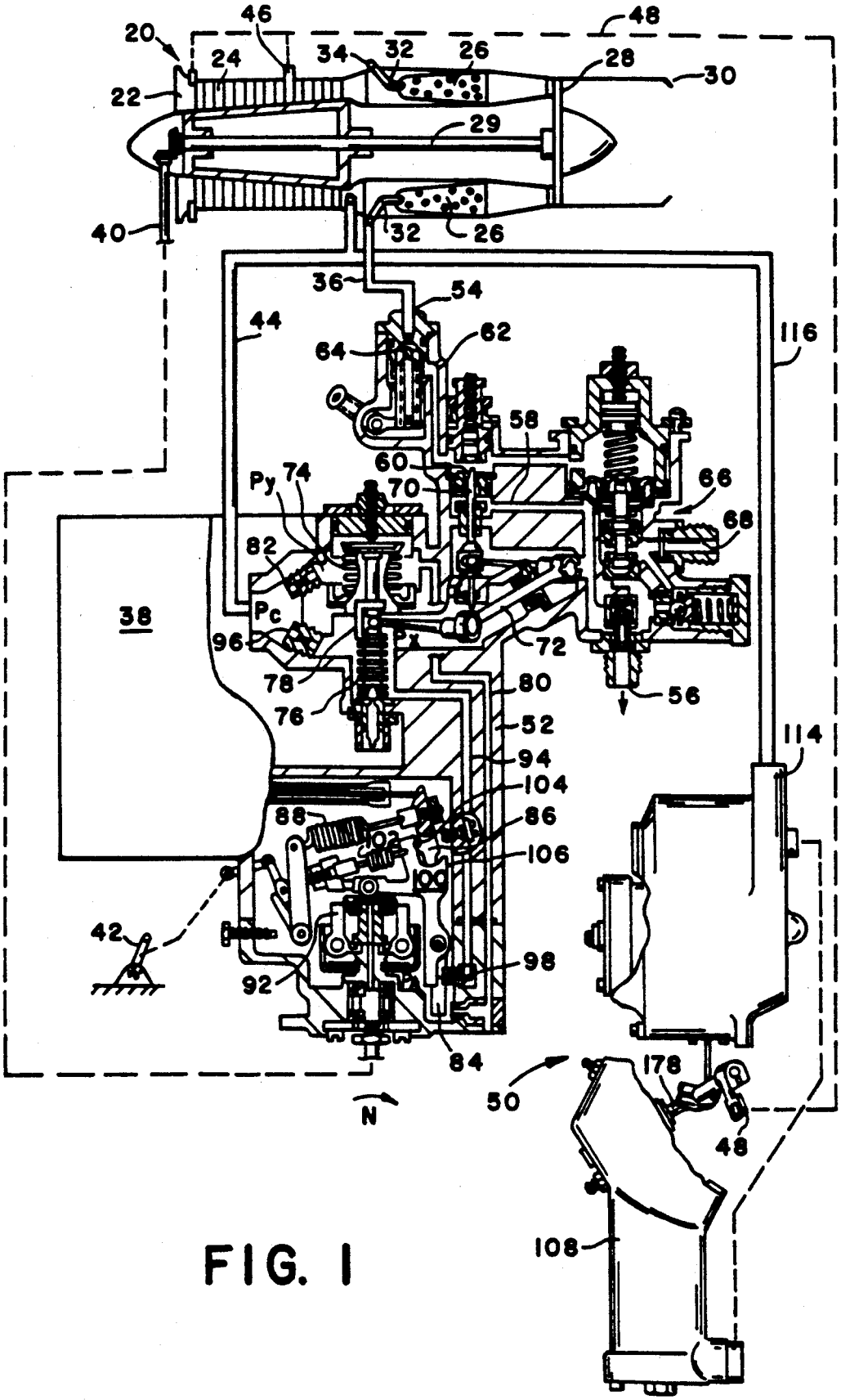
FIG. 1 is a schematic illustration of a gas turbine engine having a actuator assembly for a variable area geometry member made according to the principles of the present invention.

The control system 10 shown in FIG. 1, for a conventional gas turbine engine 20 has an air inlet 22 upstream from a multiple stage axial flow compressor 24 which discharges pressurized air flow to one or more combustion chambers 26. Hot motive gas generated in the combustion chamber 26 and discharged therefrom is passed through a gas turbine 28 connected to drive the compressor 24 via a shaft 29. The discharge gas from the gas turbine 28 is expelled through a discharge nozzle 30 thereby providing a desired propelling thrust for an aircraft.

A controlled rate of fuel flow is supplied to combustion chamber 26 via a fuel injection nozzle 32 supplied pressurized fuel by a fuel manifold 34 connected thereto and provided with a fuel supply conduit 36 leading from the outlet of a fuel control generally indicated by 38. The fuel control 38 is adapted to receive control input signals including engine rotational speed, N, via suitable gear and shafting 40, power request via a throttle lever 42 and compressor pressurized air at pressure $P_c$ via a conduit 44 providing fluid communication between control 38 and the discharge section of compressor 24.

One or more conventional compressor air bleed valves 46 suitably connected to a selected stage or stages of the compressor 24 vents compressor pressurized air therefrom to a suitable relatively low pressure drain source such as the atmosphere or environment having a fluid pressure, $P_a$. The variable area geometry device 46 is actuated by a linkage 48 connected to actuator assembly 50, more clearly illustrated in FIG. 2.

The fuel control 38 is conventional and may be of any suitable type such as that shown in U.S. Pat. No. 3,526,091 and more recently U.S. Pat. No. 5,072,578 for specific details of structure and operation of fuel control 38. A portion of the control 38 is broken away to show the operating relationship between it and the actuator assembly 50.

The fuel control 38 includes a casing 52 having an outlet 54 connected to conduit 36 and an inlet 56 connected to a source of pressurized fuel which may include a fuel tank and engine driven fuel pump, not shown. Fuel passes from inlet 56 to outlet 54 via conduit means including passage 58, a variable area fuel metering orifice 60, passage 62 and fuel cut-off valve 64. Fuel bypass valve means generally indicated by 66 responsive to a fuel pressure differential across orifice 60 diverts fuel at unmetered fuel pressure $P_l$ to a fuel bypass outlet 68 which communicates with an inlet of the fuel pump, not shown, to thereby maintain the pressure differential across orifice 60 at a predetermined constant value regardless of the effective flow area of orifice 60. A fuel metering valve 70 is suitably connected to orifice 60 and moves relative thereto to vary the flow area of the same to control the rate of fuel flow therethrough.

The valve 70 is actuated by a linkage mechanism generally indicated by 72 which responds to a governor bellows 74 and a relatively smaller evacuated acceleration bellows 76 rigidly linked together by a stem 78. The bellow 74 is responsive to air pressures $P_y$ and $P_x$ and evacuated bellows 76 is responsive to pressure $P_x$ which pressures $P_y$ and $P_x$ derived from air at compressor discharge pressure $P_c$. A conduit 80 containing a fixed area restriction 82 communicates conduit 44 at compressor discharge air pressure $P_c$ with a relatively low pressure drain source having an environmental pressure $P_a$. The effective flow area of the discharge end of passage 80 is controlled by a flapper valve 84 actuated by a lever 86. Lever 86 is force loaded by a governor spring 88 which moves in response to movement of power request lever 42 and opposing governor centrifugal weight 92 driven by gear and drive shaft 40 connected to rotate by shaft 29 at engine speed N. In this manner, the air pressure $P_y$ intermediate restriction 82 and valve 84 to which the bellows 74 is responsive is caused to vary as a function of the error between a requested engine speed and actual engine speed, N. A conduit 94 containing a fixed area restriction 96 communicates conduit 44 at compressor discharge air pressure $P_c$ with the relatively low pressure drain source or environmental pressure $P_a$. The effective flow area of the discharge end of passage 94 is controlled by a flapper valve 98 actuated by a lever 100 which is force loaded by a tension spring 102 connected to levers 100 and 86 thereby providing for a predetermined degree of movement of lever 100 relative to lever 86.

Figure 3:
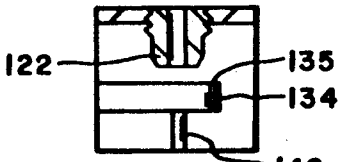
FIG. 3 is a sectional view taken along line 3—3 of FIG. 2 showing a relationship between an orifice through which compressor discharge pressure is communicated to the environment and a face on a valve responsive to a first pressure differential created between the compressor discharge pressure $P_c$ and the pressure $P_a$ of the surrounding environment.
Figure 4:
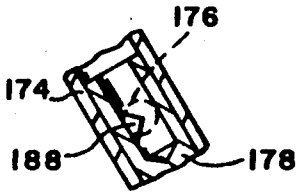
FIG. 4 is a sectional view taken along line 4—4 of FIG. 2 showing a relationship between a slot in a sleeve and an opening in a shaft to produce a variable orifice through which compressor discharge pressure is communicated into chamber in the actuator assembly.
Figure 2:
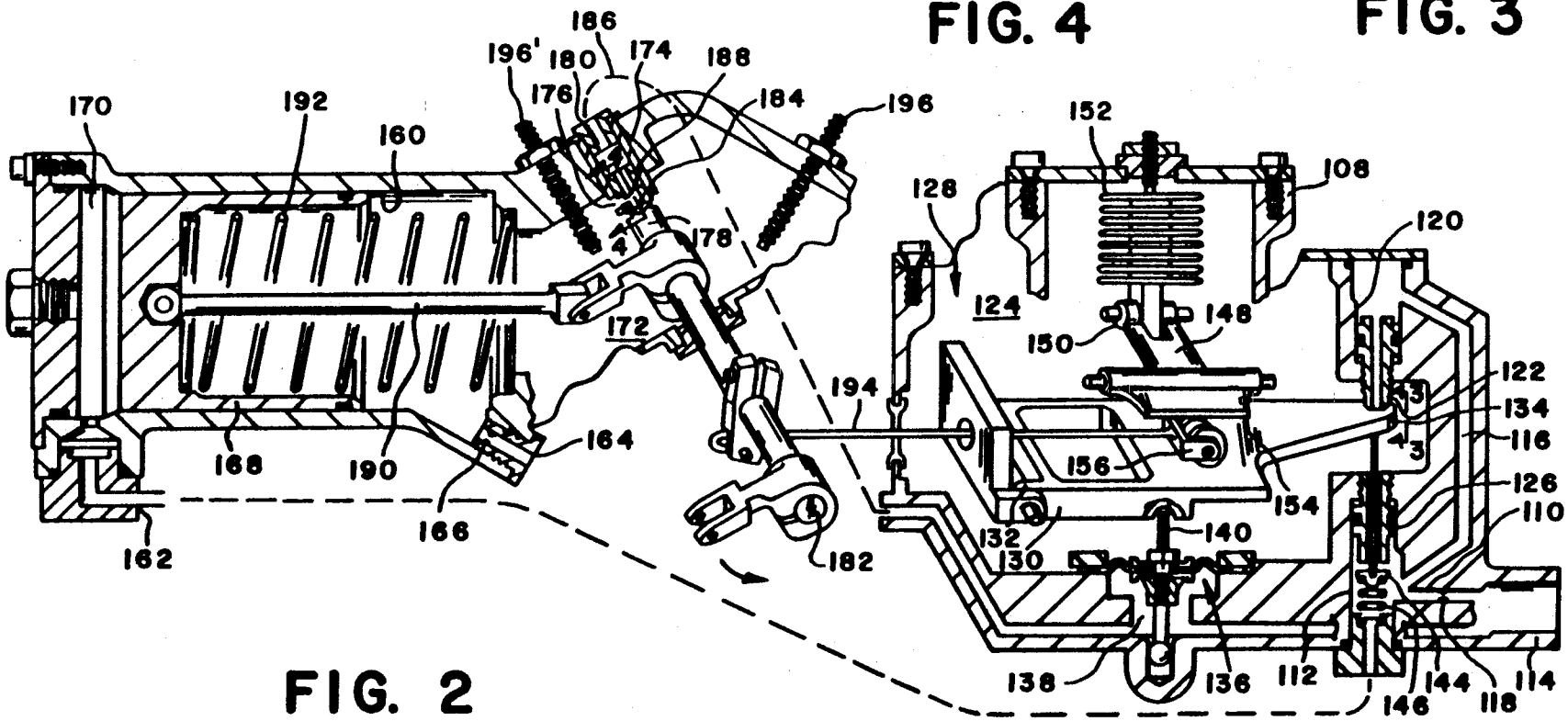
FIG. 2 is an enlarged view of the actuator assembly for the actuator assembly of FIG. 1.

The actuator assembly 50 for the variable geometry member 46 is best shown in FIGS. 2, 3 and 4. The actuator assembly 50 includes a housing 108 with an inlet port 114 connected by passage 116 to receive compressor discharge pressure $P_c$. Housing 108 has a passage 110 that connects inlet port 114 to a bore 112. A passage 116 communicates bore 112 to a bore 120 which is in axial alignment with bore 112. A restriction 118 located in passage 110 controls the flow of compressor discharge pressure $P_c$ from the inlet port 114 into bore 112. Compressor discharge pressure $P_c$ is simultaneously communicated from bore 120 through valve seat 122 and from bore 112 through valve seat 126 to chamber 124 which is at atmospheric or environmental pressure $P_a$. A lever arrangement 128 of the type disclosed in U.S. Pat. No 3,733,825 has a first lever 130 a first end 132 pivotally attached to housing 108 and a second end located in a plane perpendicular to valve seats 122 and 126 see FIG. 3. A diaphragm member 136 which seals a chamber 138 connected to inlet port 114 from chamber 124 has a pin or rod 140 that engages lever 130 a fixed distance from the pivotal connection of the first end 132. A first pressure differential created between compressor discharge pressure $P_c$ and $P_a$ acts on diaphragm member 136 to provide a corresponding force that acts on lever 130 to position face 135 on end 134 adjacent valve seat 122 to control the flow of compressor discharge pressure $P_c$ to chamber 124. A poppet 142 attached to end 134 of lever 130 has a stem that extends through the opening in seat 126 to locate a head 144 in bore 112. The distance between the face on head 144 and seat 126 and face 135 on the end 134 of lever 130 and seat 122 are designed to be identical to provide a balance effect on lever 130 even though spring 146 does provide a force that urges the lever 130 toward a closed position when $P_c$ is below a fixed pressure level such that flow through seats 120 and 126 terminates at the same time. In order to compensate for changes in the atmospheric pressure or environment $P_a$, a second lever 148 pivotally attached to said housing 108 has a first end 150 connected to an evacuated bellows 152 responsive to the fluid pressure of the environment and a second end 154 connected to the first lever 130 through a feedback roller means 156.

Housing, 108 has a bore 160 with an inlet port 162 connected a by conduit or passageway to bore 112 to receive modified compressor discharge pressure as created by the restriction of flow of compressor discharge pressure $P_c$ through seats 122 and 126 by end 134 of lever 130 and poppet 142 and an outlet port 164 with a restriction 166 located therein. A piston 168 is located in bore 160 of housing 108 for separating inlet port 162 from outlet port 164 to establish a first chamber 170 and a second chamber 172.

A sleeve 174 located in housing 108 has a radial slot 176, as best shown in FIG. 4 located therein. A shaft 178 has a first end 180 journaled in sleeve 174 and a second end 182 that extends through housing 108. Shaft 178 has a blind bore 184 connected by conduit 186 to inlet port 114 to receive compressor discharge fluid pressure $P_c$. Shaft 178 has an opening (shown as being triangular but other shapes may work equally well) 188 from the blind bore 184 which is aligned in a plane with the radial slot 176 in sleeve 174. Shaft 178 is connected to piston 168 by a rod 190 and rotated thereby as a function of linear movement of the piston 168. Rotation of shaft 178 is carried through 194 to feedback roller 156 associated with lever 130 while spring or resilient means 192 located in chamber 172 urges piston 168 toward the first chamber 170. Stops bolts 196, 196' located in housing 108 limits the rotation of shaft 178 by linear movement of piston 168 to control the maximum input to linkage 48 attached to the second end 182 thereof.

Reference may be made to the heretofore mentioned U.S. Pat. No. 3,526,091 for specific details of operation of the fuel control 38. However, for the present discussion it will be sufficient to recognize that the turbine engine 20 is accelerated as a result of levers 86 and 100 being unbalanced in a direction to close flapper valves 84 and 98, respectively. The pressures $P_x$ and $P_y$ increase accordingly to pressure $P_c$ thereby reducing the pressure differential $P_y-P_x$ across governor bellows and pressurizing acceleration bellows 76 which, in turn, results in metering valve 64 moving in an opening direction as a function of compressor discharge pressure $P_c$ to increase fuel flow and cause the engine to accelerate accordingly.

As the engine approaches the selected engine speed corresponding to the position of lever 42, the spring 88 is overcome by weights 92 causing lever 86 to move thereby opening flapper valve 84, which, in turn, causes a reduction in pressure $P_y$ allowing governor bellows 74 to expand in response to the increased $P_c-P_y$ differential thereacross thereby urging metering valve 64 in a closing direction to reduce fuel flow causing the engine to accelerate at a reduced rate and stabilize at the selected speed.

Figure 7:
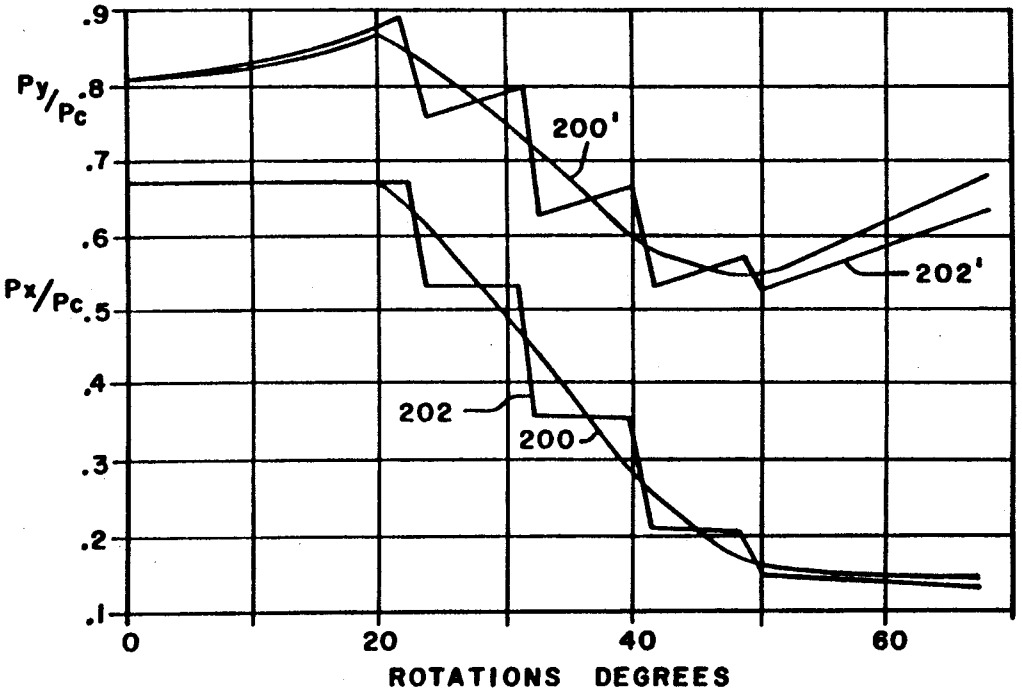
FIG. 7 is a curve illustrating the $P_x$ pressure output of the actuator assembly of FIG. 1 as supplied to linkage for operating the variable area geometry member.
Figure 6:
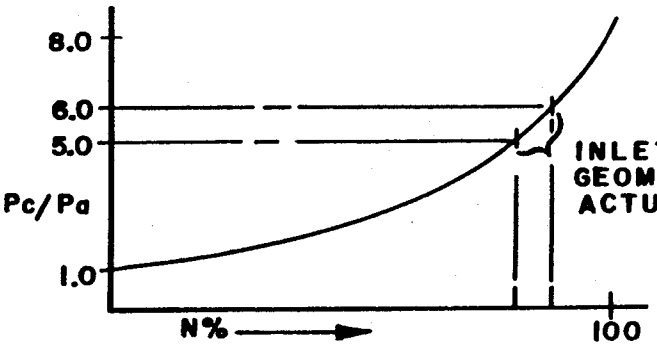
FIG. 6 is a curve illustrating the compressor pressure ration $P_c/P_a$ vs. engine speed N.

The variable area geometry device 46 is actuated by actuator assembly 50 and in particular in response to the pressure differential $P_s-P_x$ imposed on piston 168. The pressure $P_s$ being derived as a function of regulated compressor discharge pressure $P_c$ as modified by the flow from bores 112 and 116 to chamber 124 as controlled the the differential pressure $P_c-P_a$ acting across diaphragm member 136. Initially, when the turbine engine 20 is started, the force produced by pressure differential $P_c-P_a$ acting on diaphragm member 136 and the position of feedback roller 156 is such that lever 130 is positioned such that there is no flow of compressor discharge pressure through seats 122 and 126. At this same time, spring 192 urges piston 168 toward the first chamber 170 such that openings 188 and 176 are not aligned and there is no flow of compressor discharge fluid pressure to chamber 172. As the engine accelerates, compressor discharge pressure increases resulting in an increase in the compressor pressure ration $P_c/P_a$ as a function of turbine engine speed N as indicated in FIG. 6. With face 135 of lever 130 on seat 122 and poppet 144 on face 126, the modified compressor fluid pressure $P_s$ is substantially identical to the compressor fluid pressure $P_c$ presented to inlet port 14. The modified compressor fluid pressure $P_s$ is communicated to chamber 170 and at some pressure differential $P_s-P_x$ such as a ratio 5.0 is sufficient to overcomer spring 192 and linearly move piston 168 toward chamber 172 which at this time essentially has a fluid pressure $P_a$ therein. As piston 168 moves linearly, rod 190 rotates shaft 178 to move opening 188 with respect to slot 176 and create a variable opening through which compressor discharge fluid pressure present in blind bore 184 is communicated into chamber 172. Rotation of shaft 178 is communicated through rod 194 to roller feedback means 156 to move lever 130 and allow compressor discharge pressure present in bore 112 and 120 to flow into chamber 124. Compressor discharge fluid pressure $P_c$ flow into chamber 172 is a function of the restriction created by the variable opening created by the position of opening 188 with respect to radial slot 176 while fluid pressure flows out of chamber 172 as a function of the flow through restriction 166 in outlet port 164 to the environment to develop a fluid pressure $P_x$. The movement of piston 168 by pressure differential $P_s-P_x$ is communicated through shaft 178 and linkage 48 to correspondingly position the variable area geometry device 46. The rotation of shaft 178 by actuator assembly 50 is illustrated in FIG. 7 by curve 200 at sea level and curve 200' at 20,000 feet. Curves 200 and 200' shows a smooth and uniform force is supplied to operate the variable area geometry device 46 as compared with curve 202 at sea level and curve 202' at 20,000 feet which illustrates the operation thereof by the prior art.

Figure 5:
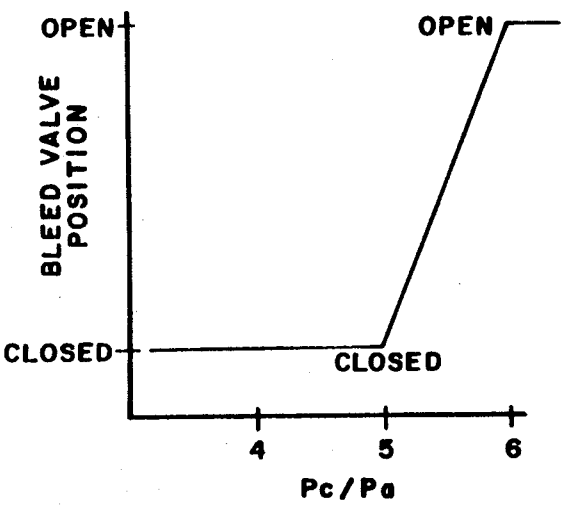
FIG. 5 is a curve illustrating variable geometry position vs. pressure ratio $P_c/P_a$.

By suitable selection of the lever arrangement 128 and variable opening created between the shaft 178 and sleeve 174 for the communication of compressor discharge pressure $P_c$ into chamber 172, the variable area geometry device 46 may be made to start closing at a predetermined pressure ratio $P_c/P_a$ and fully close at a second predetermined ratio $P_c/P_a$. As shown in FIG. 5 the variable area geometry device 46 is fully open above a pressure ratio $P_c/P_a$ of approximately 6.0. In the range from 5.0 to 6.0 the variable area geometry device occupies a partially position in proportion to the ratio $P_c/P_a$ thereby avoiding abrupt closing of the variable area geometry device 46 which abrupt closing has an undesirable tendency to induce compressor surge. In essence the variable area geometry device 46 is positioned as a function of $P_c/P_a$ while the $P_x/P_a$ pressure varies as a function to the position of the shaft 178 which provides the force to position the variable area geometry device 46. Further, the $P_x/P_c$ pressure ratio establishes the available force to open or close the variable area geometry device 46.

An acceleration of the turbine engine 20 is initiated by an increase in pressure $P_s$ to compressor discharge pressure $P_c$ in the actuator assembly 50. An increase in the compressor discharge pressure creates a corresponding increase in the force applied to lever 130 through rod 140 to create an unbalance force in the lever arrangement such that flow of compressor discharge fluid through valve seats 122 and 126 is restricted by face 135 and poppet 146 to increase the fluid pressure of $P_s$. The increase in fluid pressure $P_s$ creates a new second pressure differential which acts on piston to linear moves piston 168 and rotate shaft 178 until a force balance is again achieved in lever arrangement 128 through the input supplied by feedback roller 156. The control of variable area geometry device 46 in response to pressure ratio $P_c/P_a$ is represented by FIG. 5. It will be noted that the variable area geometry device 46 is fully open only in the $P_c/P_a$ pressure ratio is above 6.0.

An engine deceleration from the maximum speed to the idle speed results in reversal of the above-mentioned operation. It will be understood that the bleed valve 46 is fully closed in the engine speed operating range below the above-mentioned first predetermined pressure ratio $P_c/P_a$ of 5.0 and fully open in the engine speed operating range above the above-mentioned second predetermined pressure ratio $P_c/P_a$ of 6.0. In the speed range between the first and second predetermined pressure ratio $P_c/P_a$ of 5 and 6, the input from shaft 178 positions variable area geometry device 46 to a positioned intermediate the open and closed position in proportion to the pressure ratio $P_c/P_a$.

I claim:

1. In a control system for a turbine engine having a variable geometry air compressor, a valve arrangement having a first member responsive to a first operational pressure differential created between a discharge fluid pressure produced by said air compressor and an environmental fluid pressure for controlling the communication of a first fluid pressure to an actuator assembly, said actuator assembly responding to a second operational pressure differential created between said first fluid pressure and a second fluid pressure produced through a modification of said discharge fluid pressure, said second pressure differential acting on an output member connected by linkage to provide a force which correspondingly changes the geometry of said air compressor, the improvement in the actuator assembly comprising:

a housing having a bore therein with an inlet port connected to receive said first fluid pressure and an outlet port connected to the surrounding environment;

a piston located in said housing for separating said bore into a first chamber and a second chamber, said first chamber being connected to said inlet port and said second chamber being connected to said outlet port;

a restriction located in said outlet port to control the communication of any fluid pressure in said second chamber to the environment;

a sleeve located in said housing, said sleeve having a radial slot therein;

a shaft having a first end journaled in said sleeve and a second end that extends through said housing, said shaft having a blind bore therein connected to receive compressor discharge fluid pressure, said shaft having an opening therein from said blind bore aligned in a plane with said radial slot in said sleeve, said shaft being connected to said piston and rotated thereby as a function of linear movement of the piston by said second pressure differential to position said opening with respect to said radial slot and correspondingly create a variable opening from said blind bore to said second chamber, said second end being connected by said linkage to said variable geometry air compressor; and resilient means for urging said piston toward said first chamber in opposition to said second pressure differential, said second fluid pressure being developed by compressor discharge fluid pressure flowing from said blind bore through said variable opening into said second chamber and fluid pressure in said second, chamber flowing through said restriction in the outlet port to the surrounding environment, said second pressure differential moving said piston and shaft and correspondingly said linkage to linearly change the geometry of said air compressor.

2. In the control system for a turbine engine having a variable geometry air compressor as recited in claim 1 further including:

feedback means connecting said shaft with said valve arrangement for providing an input force to balance the force created by the first pressure differential acting on said first member to develop said first fluid pressure as a function of the flow of compressor fluid pressure to the surrounding environment through a second variable opening.

3. In the control system for a turbine engine having a variable geometry, air compressor as recited in claim 2 wherein said opening in said shaft has a triangular shape having an apex aligned in the center of said radial slot in said sleeve, said shaft moving said apex with respect to said radial slot to created said variable opening through with said compressor discharge pressure is communicated to said second chamber.

4. In the control system for a turbine engine having a variable geometry air compressor as recited in claim 3 wherein said valve means includes:

a first and second passages connected to receive compressor fluid pressure with corresponding first and second openings to the environment;

a first lever having a first end pivotally attached to said housing and having a second end located adjacent said first opening, said first member engaging said first lever a fixed distance from said first end;

a poppet attached to said second end and aligned with said second opening;

a second lever pivotally attached to said housing having a first end connected to an evacuated bellows responsive to the fluid pressure of the environment and a second end connected through said feedback means to said first lever, said first pressure differential creating a force communicated through said first member to move said first lever and position said second end with respect to said first opening and said poppet with respect to second end to develop said first fluid pressure as a function of said compressor fluid discharge pressure.

5. In the control system for a turbine engine having a variable geometry air compressor as recited in claim 3 further including:

stop means attached to said housing for limiting the rotation of said shaft through movement of said piston.

* * * * *